United States Patent [19]

Katz et al.

[11] Patent Number: 4,997,394

[45] Date of Patent: Mar. 5, 1991

[54] WATER RESISTANT FUSE HOLDER

[75] Inventors: Paul C. Katz, Chicago; Patrick A. Pisciotto, Wood Dale; Gary I. Robin, Niles, all of Ill.

[73] Assignee: Triplex Manufacturing Co., Chicago, Ill.

[21] Appl. No.: 526,034

[22] Filed: May 18, 1990

[51] Int. Cl.[5] ..... H01R 13/68

[52] U.S. Cl. ..... 439/622; 337/186

[58] Field of Search ..... 439/621, 622, 830; 337/186–188, 194, 198, 201, 205

[56] References Cited

U.S. PATENT DOCUMENTS

| | | | |
|---|---|---|---|
| D. 257,559 | 11/1980 | Myles | D13/35 |
| D. 265,988 | 8/1982 | Gordon | D13/35 |
| D. 276,427 | 11/1984 | Gordon | D13/35 |
| 1,978,510 | 10/1934 | Spence, Jr. | 173/328 |
| 4,107,639 | 8/1978 | Levy | 337/205 |
| 4,391,485 | 7/1983 | Urani | 339/191 S |
| 4,473,264 | 9/1984 | Julian et al. | 339/36 |
| 4,560,227 | 12/1985 | Bukala | 439/621 X |
| 4,648,674 | 3/1987 | Sanchez, Jr. | 339/97 P |
| 4,731,032 | 3/1988 | Noorily | 439/136 |
| 4,753,614 | 6/1988 | Weiner | 439/717 |
| 4,767,339 | 8/1988 | Comerci | 439/716 |
| 4,830,631 | 5/1989 | Hsueh | 439/622 |

FOREIGN PATENT DOCUMENTS 3512624 7/1986 Fed. Rep. of Germany ..... 439/621

*Primary Examiner*—Eugene F. Desmond

*Attorney, Agent, or Firm*—Fitch, Even, Tabin & Flannery

[57] ABSTRACT

A water resistant fuse holder for receiving a fuse of the plastic body type. The fuse holder includes a fuse body including a housing for retaining a pair of terminal elements for receiving the terminal legs of the fuse. The housing has an upper wall and a mouth extending from the upper wall and defining a cavity opening onto the leg-receiving ends of the terminal elements. The mouth terminates in an engagement surface and the mouth further includes a peripheral outer rim located adjacent the engagement surface. The fuse holder also includes a cap of resilient insulative material including a side wall defining a recess for receiving the mouth and the fuse body. The side wall has an internal ledge encompassing the recess and having an abutment surface for entering into substantially full surface engagement with the engagement surface of the mouth. The side wall further has an internal rib encompassing the recess and positioned between the ledge and the base surface of the cap. The spacing between the rib and the ledge is substantially equal to the height of the rim and the rib and the ledge define a groove for receiving the rim.

9 Claims, 2 Drawing Sheets

WATER RESISTANT FUSE HOLDER

This invention relates to electrical safety components and, more particularly, to a fuse holder for a fuse of the type including a fusible link encapsulated in a plastic fuse body.

BACKGROUND OF THE INVENTION

Fuses of the relatively flat, plug-in type having a fuse link encapsulated in a plastic fuse body with a pair of terminal legs depending from the fuse body, have become very popular, particularly in automotive applications. Such fuses are usually smaller, much more sturdy, and easier to handle than glass-bodied cylindrical fuses having comparable current ratings. As the plastic body fuses are of the plug-in type, holders for the new fuses usually include a relatively sturdy body for withstanding the necessary insertion force, as opposed to the simpler telescoping type holder typically used for the glass-bodied fuse. Also the terminals of the new fuses tend to be closer to each other than the terminals of the glass bodied fuses. The entrance of moisture into the fuse holder, in an extreme situation, could result in current shunting or bypassing the fuse link to partially defeat the purpose of the fuse. Another disadvantage of the entrance of moisture is the possible corrosion of metallic terminal legs of the fuse and the female terminal elements of the holder.

U.S. Pat. No. 4,473,264 to Julian et al. discloses a sealing cap for a battery cable. The cap interior surface includes an annular groove for mating with an annular rim on the outside surface of the tubular portion. The cap is held to the battery cable by a filament joined to a circular eyelet through which the battery cable passes. U.S. Pat. No. 1,978,510 to Spence, Jr. and U.S. Pat. No. 4,731,032 to Noorily also disclose tethered caps for connectors. U.S. Design Pat. Nos. 276,427 and 265,988 to Gordon and U.S. Design Pat. No. 257,559 to Myles show fuse holders for a plastic body fuse.

U.S. Pat. No. 4,107,639 to Levy teaches a fuse mount for a fuse of the type having a glass envelope, including a cap portion connected to a base portion by hinges. The cap includes a split circular claw for holding the fuse prior to its insertion into the cavity of the body which holds terminals for contacting the metallic ends of the fuse.

U.S. Pat. No. 4,753,614 to Weiner illustrates electrical jacks which can be ganged. Each jack includes an arm extending from wall of the jack terminating in a tooth for reception through an aperture in a facing wall of another jack, to permit holding of multiple jacks in ganged relationship.

SUMMARY OF THE INVENTION

Among the several aspects and features of the present invention may be noted the provision of an improved fuse holder for a plastic body fuse. The holder includes a body or base and a cap which, when mated with the body, completely encloses the fuse and provides a double seal to resist the entrance of moisture or other fluids into the holder. In one embodiment, the holders can easily be joined in ganged relationship. Furthermore the cap and the body are tethered together to preclude misplacing of loose components. The holder of the present invention is reliable in use, has long service life, and is relatively easy and economical to manufacture. Other aspects and features of the present invention will be in part apparent and in part pointed out specifically hereafter in the following specification and in the accompanying drawings.

Briefly, the fuse holder includes a holder body including a housing retaining a pair of terminal elements which are spaced to match the terminal legs of the fuse. Each element includes a female terminal leg-receiving end and another end for connection to the core of an insulated conductor. The housing includes an upper wall, and there is a mouth extending from the housing upper wall defining a cavity opening onto the leg-receiving ends of the terminal elements. The mouth has a distal end terminating in an engagement surface with the mouth further including a peripheral outer rim located adjacent the engagement surface. The fuse holder also includes a cap formed of resilient insulative material and including a side wall defining a recess for receiving the mouth and the plastic fuse body. The cap has a top wall, and a base surface for facing the housing upper wall. The side wall of the cap is provided with an internal ledge encompassing the recess and having an abutment surface for contacting the engagement surface of the mouth. The side wall also has an internal rib encompassing the recess and positioned between the ledge and the base surface with the spacing between the rib and ledge being substantially equal to the height of the rim.

BRIEF DESCRIPTION OF THE DRAWINGS

Corresponding reference characters indicated corresponding components throughout the several views of the drawings.

DESCRIPTION OF THE PREFERRED EMBODIMENTS

Figure 1:
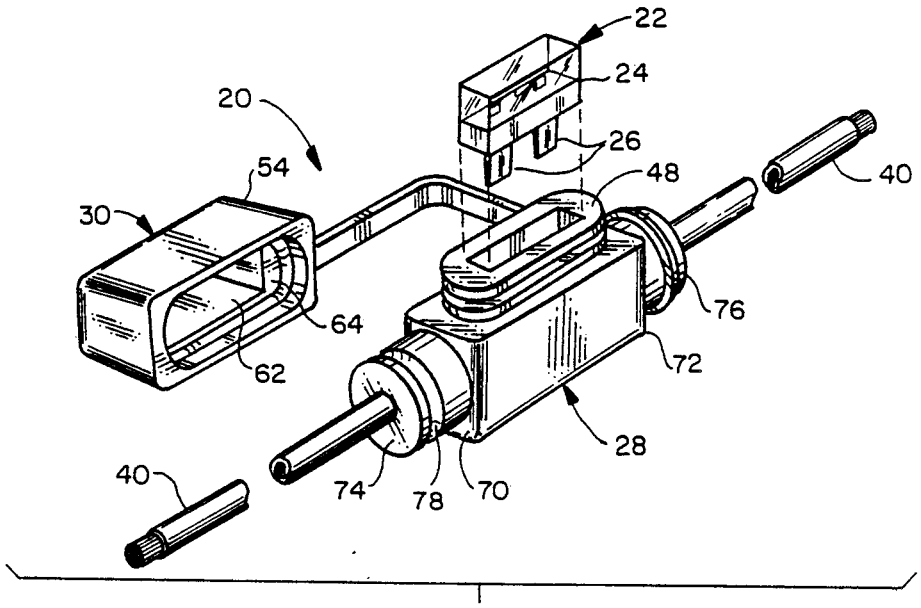
FIG. 1 is a perspective view of a fuse holder, embodying various aspects of the present invention, with a fuse being positioned for insertion into the holder.

Referring now to the drawings, a fuse holder embodying various aspects of the present invention is generally indicated in FIG. 1 by reference numeral 20. The holder 20 is adapted to receive a fuse 22 of the type including a fusible link encapsulated in a plastic fuse body 24 with a pair of spaced terminal legs 26, each electrically and mechanically connected to an end of the fusible link, depending from the fuse body. The fuse holder includes a holder body 28, best shown in FIGS. 2–4, and a cap 30, best shown in FIGS. 5 and 6. When the cap is mounted on the body as shown in FIG. 7, the fuse holder functions to provide a degree of water resistance to protect the fuse 22 mounted therein. Both the body 28 and the cap 30 are formed of resilient insulative material, a preferred material being Alcryn, a registered trademark of DuPont for melt processible rubber. Thus both the body and the cap can conveniently be formed by molding because Alcryn is a thermoplastic.

More specifically, the holder body 28 is of one-piece construction and includes a housing 31 which retains a pair of metallic terminal elements 32 spaced to match the terminal legs 26. Each element includes a female terminal leg-receiving end 34 made up of a pair of resiliently deflectable fingers defining a socket for a leg 26, and another end 36 adapted to be connected to the core 38 of an insulated conductor 40. The housing has an upper wall 42 and the body 28 also includes a mouth 44 extending upwardly from the upper wall and defining a cavity 46 opening onto the leg-receiving ends 34 for accommodating the fuse body 24. The mouth 44 has a distal end terminating in an engagement surface 48. The mouth further includes an upper peripheral outer rim 50 disposed adjacent the engagement surface 48, and a lower peripheral outer rim 52 located between the upper rim 50 and the upper wall 42.

Figure 5:
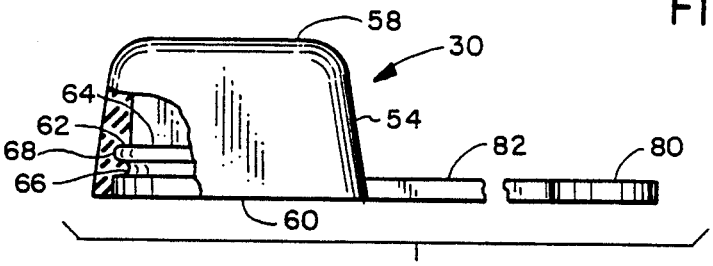
FIG. 5 is a front elevational view of the cap with a portion of the side wall removed.
Figure 6:
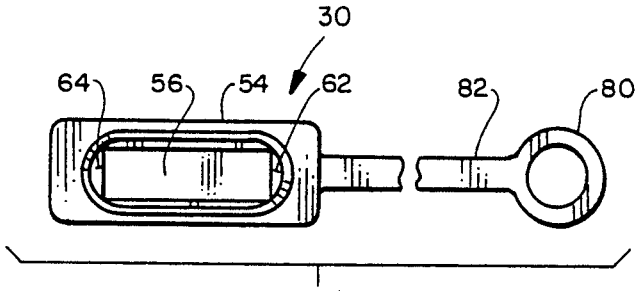
FIG. 6 is a bottom elevational view of the cap.
Figure 7:
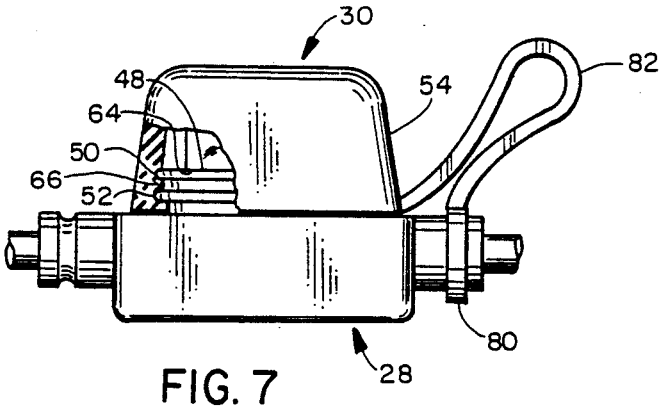
FIG. 7, similar to FIG. 2, shows the cap mounted on the holder body with facing surfaces in engagement to provide a degree of resistance to the entrance of water into the body.

Referring to FIGS. 5 and 6, the cap 30 is also of one-piece construction and includes a side wall 54 defining a recess 56 for receiving the mouth 44 and the fuse body 24. The cap also includes a top wall 58 and a base surface 60 for facing the housing upper wall 42. The side wall 54 has an internal ledge 62 encompassing the recess 56 with the ledge including an abutment surface 64 for entering into substantially full surface contact with the engagement surface 48 of the mouth, as shown in FIG. 7. The side wall 54 also includes an internal rib 66 also encompassing the the recess and disposed between the ledge and the base surface. The spacing between the rib 66 and the ledge 62 is substantially equal to the height of the upper rim 50 of the mouth 44 with the rib and the ledge defining a groove 68 for the receiving the upper rim. Additionally the lower rim 52 is spaced a distance from the upper rim a distance substantially equal to the height of the internal rib 66 so that the rims can cooperate to hold the rib. Preferably the spacing between the housing upper wall 42 and the engagement surface 48 is greater than the spacing between the abutment surface 64 and the base surface 60. It will be appreciated that as both the cap and the body are formed of resilient material, the rims and rib will tend to deflect as the cap is mounted. By providing the extra space between the housing upper wall and the engagement surface, the cap can be moved sufficiently close to the upper wall to permit the rims and rib to interfit, even though they are somewhat deflected. Upon release of the cap, the resiliency of the components will slightly lift the cap away from the upper wall because the rims and rib will return toward their as-molded positions.

The configuration of the mouth 44 and the cap 30 provide a double seal to oppose the access of moisture to the fuse retained in the fuse holder thereby offering a degree of water resistance. The first seal is provided by the rims 50 and 52 interfitting with the rib 66. The second seal is provided by the engagement surface 48 of the mouth being in close proximity to and preferably pressing against the abutment surface 64 of the ledge 62. While the fuse holder 20 is not intended for underwater application, it will offer a degree of protection when used in an environment where water could occasionally drip on or splash against the fuse holder.

Figure 2:
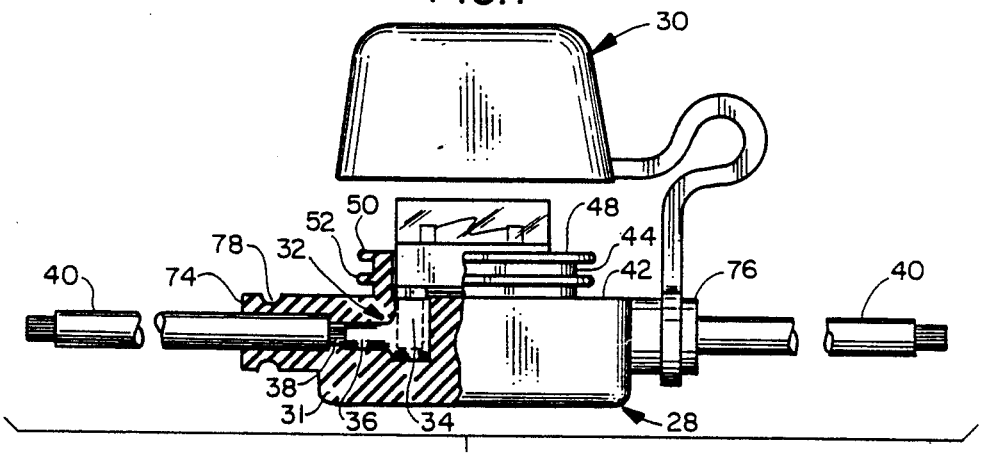
FIG. 2 is a front elevational view of the fuse holder, including a holder body and a cap attached to the holder by a tether, with components of the body removed to expose underlying components.
Figure 3:
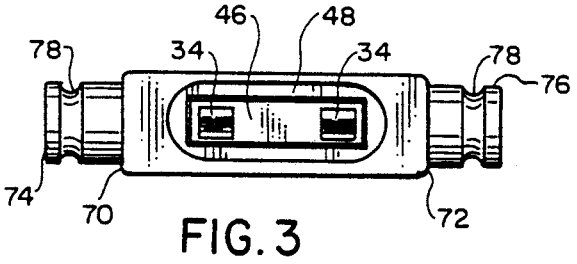
FIG. 3 is a plan view of the holder body.
Figure 4:
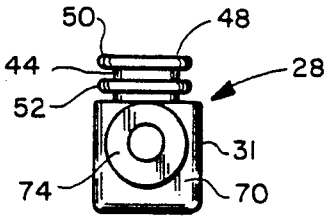
FIG. 4 is a side elevational view of the holder body.

As best shown in FIGS. 1–3, the fuse body housing 31 has a first end 70 and a second end 72 with a first tubular extension 74 projecting from the first end 70 and a second tubular extension 76 projecting from the second end 72. Each extension projects generally normal to the mouth 44, and the insulated conductor 40 connected to each terminal element 32 passes through a corresponding extension. The terminal elements with the conductors connected thereto are preferably held by a jig so that the mold for forming the holder body ca close about the terminal elements prior to injection of the molten thermoplastic material. The outer surface of each extension is provided with a peripheral groove 78. The cap 30 includes a resiliently expandable eyelet 80 sized for reception in one of the grooves 78, and a tether 82 joining the eyelet to the side wall 54 of the cap. Thus the cap can be removed from the mouth 44 to permit changing of a blown fuse without the cap becoming disassociated from the holder body 28. There is therefore no need to keep track of loose holder parts, and the cap is readily available for replacement after insertion of a new fuse into the holder body.

Figure 10:
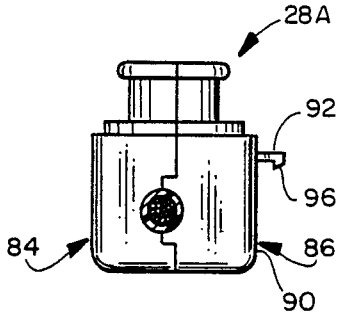
FIG. 10 is a side elevational view of the holder body of FIG. 8.
Figure 8:
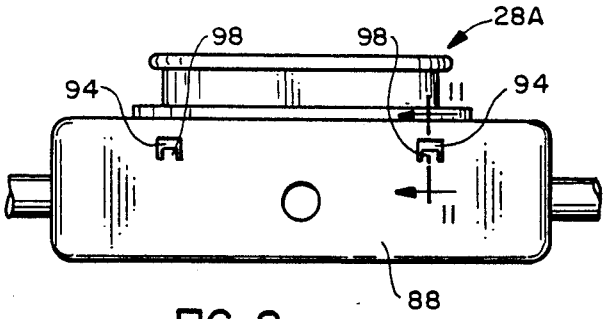
FIG. 8 is a front elevational view of an alternate embodiment of the holder body of the present invention.
Figure 9:
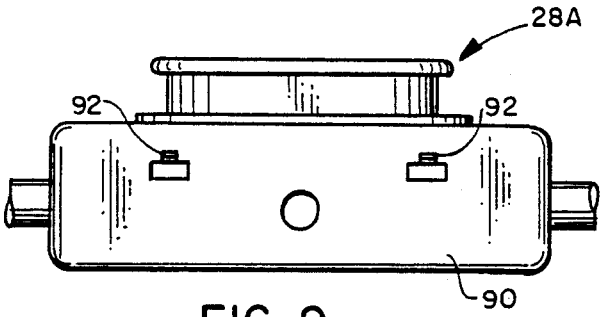
FIG. 9 is a rear elevational view of the holder body of FIG. 8.

The fuse holder 20, in which the length from the end of the first extension 74 to the end of the second extension 76 is about 1½ inches, is for use with fuses 22 having amperage ratings of about 30 amps and below. Referring now to FIGS. 8–10, an alternate embodiment of the holder body is generally indicated by reference character 28A. Components of the holder body 28A corresponding to those of holder body 28 are indicated by the reference numeral applied to the component of holder body 28 with the suffix "A". The holder body 28A is adapted for use with larger fuses 22 having ratings as high as about 100 amperes. While the holder body 28A is for use with an enlarged version of the cap 30 formed of melt processible rubber, the holder body 28A is relatively rigid, one suitable material being glass filled nylon. Body 28A is preferably formed of two halves 84 and 86 (as shown in FIG. 10) which are ultrasonically welded together after the appropriate terminal elements with the associated insulated conductors connected thereto have been placed into the halves.

Figure 11:
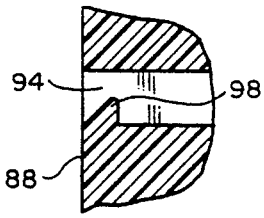
FIG. 11 is an enlarged fragmentary sectional view taken generally along line 11—11 of FIG. 8 illustrating an internal latching tooth in the holder body.
Figure 12:
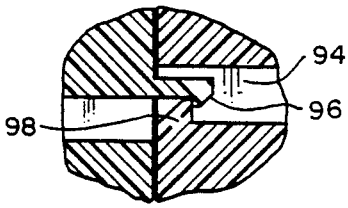
FIG. 12, similar to FIG. 11, illustrates two holder bodies joined together.

The holder body 28A has a front wall 88 and a rear wall 90. A pair of spaced arms 92 extends from the rear wall 90 while the front wall 88 includes a pair of spaced windows 94 aligned with the arms 92 for receiving the arms. The arms and the rear wall include locking means for holding the arms in the windows so that a number of holder bodies can be held in ganged relationship. More specifically, the locking means include a tooth 96 at the end of each arm. The locking means further include a catch 98 extending into each window (as shown in FIG. 11) in the opposite direction to the direction of extension of the tooth from the arm. As shown in FIG. 12, when the arm 92 is inserted into the corresponding window 94, the tooth 96 and catch 98 undergo a combination of deflection and deformation until the tooth passes the catch at which time the rear abutment surface of the tooth is positioned to engage the catch to hold the ganged holder bodies joined.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A water resistant fuse holder for receiving a fuse of the type including a fusible link encapsulated in a plastic fuse body with a pair of terminal legs depending from the fuse body, said fuse holder comprising:

a holder body formed of insulative material and including a housing for retaining a pair of spaced terminal elements spaced to match said terminal legs, each element including a female terminal leg-receiving end and another end adapted to be connected to the core of an insulated conductor, said housing having an upper wall, said holder body further including a mouth extending from said housing upper wall and defining a cavity opening onto the leg-receiving ends of said terminal elements, said mouth having a distal end terminating in an engagement surface, said mouth further including a peripheral outer rim located adjacent said engagement surface; and a cap formed of resilient insulative material and including a side wall defining a recess for receiving said mouth and said plastic fuse body, and further including a top wall and a base surface for facing said housing upper wall, said side wall having an internal ledge encompassing said recess and having an abutment surface for entering into substantially full surface engagement with said engagement surface, said side wall further including an internal rib encompassing said recess and disposed between said ledge and said base surface, the spacing between said rib and said ledge being substantially equal to the height of said rim, said rib and said ledge defining a groove for receiving said rim.

2. A holder as set forth in claim 1 wherein the spacing between the housing upper wall and the engagement surface is greater than the spacing between said abutment surface and said base surface.

3. A holder as set forth in claim 1 wherein said rim is an upper rim, said mouth further including a lower peripheral rim disposed between said upper rim and said housing upper wall and spaced from said upper rim a distance substantially equal to the height of said internal rib so that said rims can cooperate to hold said rib.

4. A holder as set forth in claim 1 wherein said housing has a first end and a second end and further includes first and second tubular extensions projecting from said first and second ends, respectively, each extension projecting generally normal the direction of extension of said mouth, the insulated conductor connected to each terminal element passing through a corresponding extension.

5. A holder as set forth in claim 4 wherein each of said extensions includes an outer surface having a peripheral groove, said cap further including a resiliently expandable eyelet sized for reception in a said peripheral groove and a tether joining said eyelet to said side wall.

6. A holder as set forth in claim 1 wherein said holder body and said cap are each of molded thermoplastic construction, and are each made of melt processible rubber.

7. A holder as set forth in claim 1 wherein said cap is of molded thermoplastic construction, said holder body being relatively rigid with respect to said cap, said holder body being formed of a pair of body halves which are welded together.

8. A holder as set forth in claim 1 wherein said holder body has a front wall and a rear wall, said holder body including a pair of spaced arms extending from said front wall, said rear wall having a pair of spaced windows aligned with said arms for receiving said arms, said arms and said rear wall comprising locking means for holding said arms in said windows whereby a number of said holder bodies can be held in ganged relationship.

9. A water resistant fuse holder for receiving a fuse of the type including a fusible link encapsulated in a plastic fuse body with a pair of terminal legs depending from the fuse body, said fuse holder comprising:

a holder body formed of resilient insulative material and including a housing retaining a pair of spaced terminal elements spaced to match said terminal legs, each element including a female terminal leg-receiving end and another end connected to the core of an insulated conductor, said housing having an upper wall, said holder body further including a mouth extending from said housing upper wall and defining a cavity opening onto the leg-receiving ends of said terminal elements, said mouth having a distal end terminating in an engagement surface, said mouth further including a peripheral outer rim located adjacent said engagement surface; and a cap formed of resilient insulative material and including a side wall defining a recess for receiving said mouth and said plastic fuse body, and further including a top wall and a base surface for facing said housing upper wall, said side wall having an internal ledge encompassing said recess and having an abutment surface for entering into substantially full surface engagement with said engagement surface, said side wall further including an internal rib encompassing said recess and disposed between said ledge and said base surface, the spacing between said rib and said ledge being substantially equal to the height of said rim, said rib and said ledge defining a groove for receiving said rim, the spacing between the housing upper wall and the engagement surface being greater than the spacing between said abutment surface and said base surface, said housing having a first end and a second end and further including first and second tubular extensions projecting from said first and second ends, respectively, each extension projecting generally normal to the direction of extension of said mouth, the insulated conductor connected to each terminal element passing through a corresponding extension, each of said extensions including an outer surface having a peripheral groove, said cap further including a resiliently expandable eyelet sized for reception in a said peripheral groove and a tether joining said eyelet to said side wall.

* * * * *

UNITED STATES PATENT AND TRADEMARK OFFICE

CERTIFICATE OF CORRECTION

PATENT NO. : 4,997,394

DATED : March 5, 1991

INVENTOR(S) : Paul C. Katz, et al.

It is certified that error appears in the above-identified patent and that said Letters Patent is hereby corrected as shown below:

In Column 1, line 50, after the word "from" insert --a--.

In Column 2, line 58, change the word "indicated" to read the word --indicate--.

In Column 3, line 41, delete the second occurrence of the word "the".

In Column 3, line 45, after the word "for" delete the word --the--.

In Column 4, line 16, delete the term "ca" and insert in its stead the word --can--.

In Column 5, line 57 (Claim 4), after the word "normal" insert the word --to--.

Signed and Sealed this

Sixth Day of October, 1992

*Attest:*

DOUGLAS B. COMER

*Attesting Officer*

*Acting Commissioner of Patents and Trademarks*